US009226579B2

(12) United States Patent
Kassanoff et al.

(10) Patent No.: US 9,226,579 B2
(45) Date of Patent: Jan. 5, 2016

(54) MODULAR DESK SYSTEMS AND METHODS

(71) Applicant: Paragon Furniture, LP, Arlington, TX (US)

(72) Inventors: Richard Kassanoff, Dallas, TX (US); Robert Larry Stewart, Grapevine, TX (US)

(73) Assignee: Paragon Furniture LP, Arlington, TX (US)

( * ) Notice: Subject to any disclaimer, the term of this patent is extended or adjusted under 35 U.S.C. 154(b) by 0 days.

(21) Appl. No.: 14/069,168

(22) Filed: Oct. 31, 2013

(65) Prior Publication Data

US 2014/0123882 A1 May 8, 2014

Related U.S. Application Data

(60) Provisional application No. 61/767,672, filed on Feb. 21, 2013, provisional application No. 61/722,028, filed on Nov. 2, 2012.

(51) Int. Cl.

| | |
|---|---|
| ***A47B 85/00*** | (2006.01) |
| ***A47B 87/00*** | (2006.01) |
| ***A47B 41/00*** | (2006.01) |

(52) U.S. Cl.

CPC ..... *A47B 87/002* (2013.01); *A47B 41/00* (2013.01)

(58) Field of Classification Search

CPC ..... A47B 21/06; A47B 2021/062; A47B 2021/064; A47B 2021/066; A47B 2021/068; A47B 83/001; A47B 13/16; A47B 87/002; A47B 41/00

USPC ..... 108/50.02, 50.01, 64, 65, 25, 26, 27, 108/28, 91

See application file for complete search history.

(56) References Cited

U.S. PATENT DOCUMENTS

| | | | | |
|---|---|---|---|---|
| 2,794,695 | A * | 6/1957 | Heal | 108/146 |
| 5,083,512 | A * | 1/1992 | Newhouse et al. | 108/50.02 |
| 5,606,920 | A * | 3/1997 | Meyer et al. | 108/50.02 |
| 5,752,449 | A * | 5/1998 | Simon et al. | 108/50.02 |
| 5,878,673 | A * | 3/1999 | Kramer et al. | 108/50.02 |
| 6,170,410 | B1 * | 1/2001 | Gioacchini et al. | 108/153.1 |
| 6,336,414 | B1 * | 1/2002 | Stewart et al. | 108/50.02 |
| 7,451,918 | B2 * | 11/2008 | Vogt | 235/379 |
| 7,757,612 | B2 * | 7/2010 | Korber et al. | 108/25 |
| 8,312,820 | B2 * | 11/2012 | Rotlevi et al. | 108/50.01 |
| 8,424,464 | B2 * | 4/2013 | Korpi | 108/9 |
| 2001/0013305 | A1 * | 8/2001 | Funk et al. | 108/50.02 |
| 2003/0024447 | A1 * | 2/2003 | Risdall et al. | 108/153.1 |
| 2003/0037709 | A1 * | 2/2003 | Kolavo | 108/50.01 |
| 2004/0035332 | A1 * | 2/2004 | Lin | 108/50.01 |
| 2006/0081157 | A1 * | 4/2006 | Gayhart et al. | 108/50.02 |
| 2007/0000414 | A1 * | 1/2007 | Riddiford et al. | 108/50.01 |
| 2007/0022918 | A1 * | 2/2007 | Sweet et al. | 108/50.02 |

(Continued)

*Primary Examiner* — Hanh V Tran

(74) *Attorney, Agent, or Firm* — Kelly J. Kubasta; Elizabeth Philip Dahm; Ferguson, Braswell & Fraser, PC

(57) ABSTRACT

A modular desk system may include, a plurality of configurable components including a top panel, an all-purpose hook, a cup hook, a storage shelf, a connecting shelf, a connecting planter box, a connecting divider, a connecting platform, a desktop organization member, a channel, a kickstand base, a support frame, and methods of forming configuration assemblies from such components. The configuration assemblies of the modular desk system may be paired with and coupled to other desk units and/or furniture.

20 Claims, 10 Drawing Sheets

(56) References Cited

U.S. PATENT DOCUMENTS

2010/0224105 A1* 9/2010 Abel et al. ..... 108/91
2011/0075337 A1* 3/2011 Riley et al. ..... 361/679.2
2011/0101195 A1* 5/2011 Skolnik ..... 248/446
2011/0297052 A1* 12/2011 Martin et al. ..... 108/27
2014/0124641 A1* 5/2014 Kassanoff et al. ..... 248/447

* cited by examiner

MODULAR DESK SYSTEMS AND METHODS

CROSS REFERENCE TO RELATED APPLICATIONS

This application claims the benefit under 35 U.S.C. §119 (e) of U.S. Provisional Patent Application Ser. No. 61/767,672 filed on Feb. 21, 2013, entitled "Modular Desk Systems," and U.S. Provisional Patent Application Ser. No. 61/722,028 filed on Nov. 2, 2012, entitled "Modular Desk Systems," each of which is incorporated by reference in its entirety.

FIELD OF THE DISCLOSURE

The present disclosure relates generally to modular furniture and, in particular, to modular desk systems and methods.

BACKGROUND

Conventional desk systems typically have a fixed construction that, inhibits adaptability to various uses, and such systems are generally standalone units that cannot readily pair with or couple to other desk units or furniture. Moreover, conventional desk systems typically comprise standard, flat desktops of limited space, having a leg supporting each corner of the desktop.

SUMMARY

Embodiments of the present disclosure generally provide modular desk systems comprising a plurality of components that may include, but are not limited to, a top panel, an all-purpose hook, a cup hook, a storage shelf, a connecting shelf, a connecting planter box, a connecting divider, a connecting platform, a desktop organization member, a channel, a kickstand base, a support frame, or any combination thereof.

Embodiments of the present disclosure further provide methods of assembling modular desk system components into configuration assemblies for a variety of different uses, including, for example, providing a work space, a reading space, a writing space, a space for use in conjunction with educational study, storing objects, displaying items, organizing, supporting and displaying electronic media, pairing with and coupling a configuration assembly to other desk units and/or furniture, or any combination thereof.

Embodiments of the present disclosure may provide a first linked desk system including a support frame comprising a pair of G-shaped spine members coupled through a kickstand base, a top panel having a lip sealed thereto, a storage shelf, and a desktop organization and display stand system. The kickstand base may include stoppers to engage the kickstand base with a floor surface. The C-shaped spine members may include footcaps to engage the C-shaped spine members with a floor surface. The first linked desk system may further include at least one accessory hook, wherein the accessory hook is selected from the group including an all-purpose hook and a cup hook. The first-linked desk system may further include a channel coupled to the support frame to store, route, secure or otherwise organize wires, cables, and other electronic media.

The desktop organization and display stand system may include a housing coupled to a portion of the first linked desk system, the housing having a central opening, the portion of the first linked desk system selected from the group including the support frame and the top panel, a top panel coupled to the housing at a pivot point such that the top panel is flippable between a closed position and an open position, at least one ledge member coupled to an inner surface of the housing, and a nest coupled to the housing capable of securing and storing electronic devices, books, and other objects. The top panel may include ridges to retain objects when the top panel is in the closed position. The top panel may be flush against an upper surface of the housing when the top panel is in the closed position, and the top panel may lean against the housing when the top panel is in the open position, such that, the top panel and the at least one ledge member form a display stand.

Embodiments of the present disclosure may provide a modular desk assembly including a first linked desk system, a second linked desk system, and a connection device therebetween. The first linked desk system may include a first support frame comprising a pair of C-shaped spine members coupled through a kickstand base, a first top panel having a lip sealed thereto, a first storage shell, and a first desktop organization and display stand system. The second linked desk system may include a second support frame comprising a pair of C-shaped spine members coupled through a kickstand base, a second top panel having a lip sealed thereto, a second storage shelf, and a second desktop organization and display stand system. The connection device may be selected from the group including a connecting shelf, a connecting planter box, a connecting divider, and a connecting platform. The kickstand base of both the first linked desk system and the second linked desk system may further include stoppers to engage each kickstand base with a floor surface. Each of the first linked desk system and the second linked desk system may further include footcaps to engage the C-shaped spine members with a floor surface.

Each of the first desktop organization and display stand system and the second desktop organization and display stand system may include a housing coupled to a portion of the first linked desk system, the housing having a central opening, the portion of the first linked desk system selected from the group including the support frame and the top panel, a top panel coupled to the housing at a pivot point such that the top panel may be flippable between a closed position and an open position, at least one ledge member coupled to an inner surface of the housing and a nest coupled to the housing capable of securing and storing electronic devices, books, and other objects.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Embodiments of the present disclosure generally provide a modular desk system comprising a plurality of configurable components and methods of forming configuration assemblies from such components. In certain embodiments, the present disclosure may provide modular desk systems configured for pairing with and coupling to other desk units and/or furniture.

FIGS. 1-5 illustrate representative configurations 100*a*, 100*b*, 100*c*, 100*d*, 100*e* and 100*f* of a modular desk system and components thereof. A modular desk system may comprise a plurality of components assembled to form configurations 100*a*, 100*b*, 100*c*, 100*d*, 100*e* and 100*f*. It should be understood that the components of a modular desk system forming the configurations 100*a*, 100*b*, 100*c*, 100*d*, 100*e*, 100*f* and parts thereof shown in FIGS. 1-5 are for illustrative purposes only, and that any other suitable components or subcomponents may be used in conjunction with or in lieu of the components comprising a modular desk system and parts thereof.

The components of a modular desk system may generally comprise one or more of top panel, all-purpose hook, cup hook, storage shelf, connecting shelf, connecting planter box, connecting divider, connecting platform, desktop organization member, channel, kickstand base, support, frame member, other suitable components, or any combination thereof according to embodiments of the present disclosure. The components of a modular desk system may be customized, reconfigured, or adjusted to provide a certain size, shape, configuration, position, purpose, utility, decorative look, other suitable disposition, or any combination thereof.

Figure 1A:
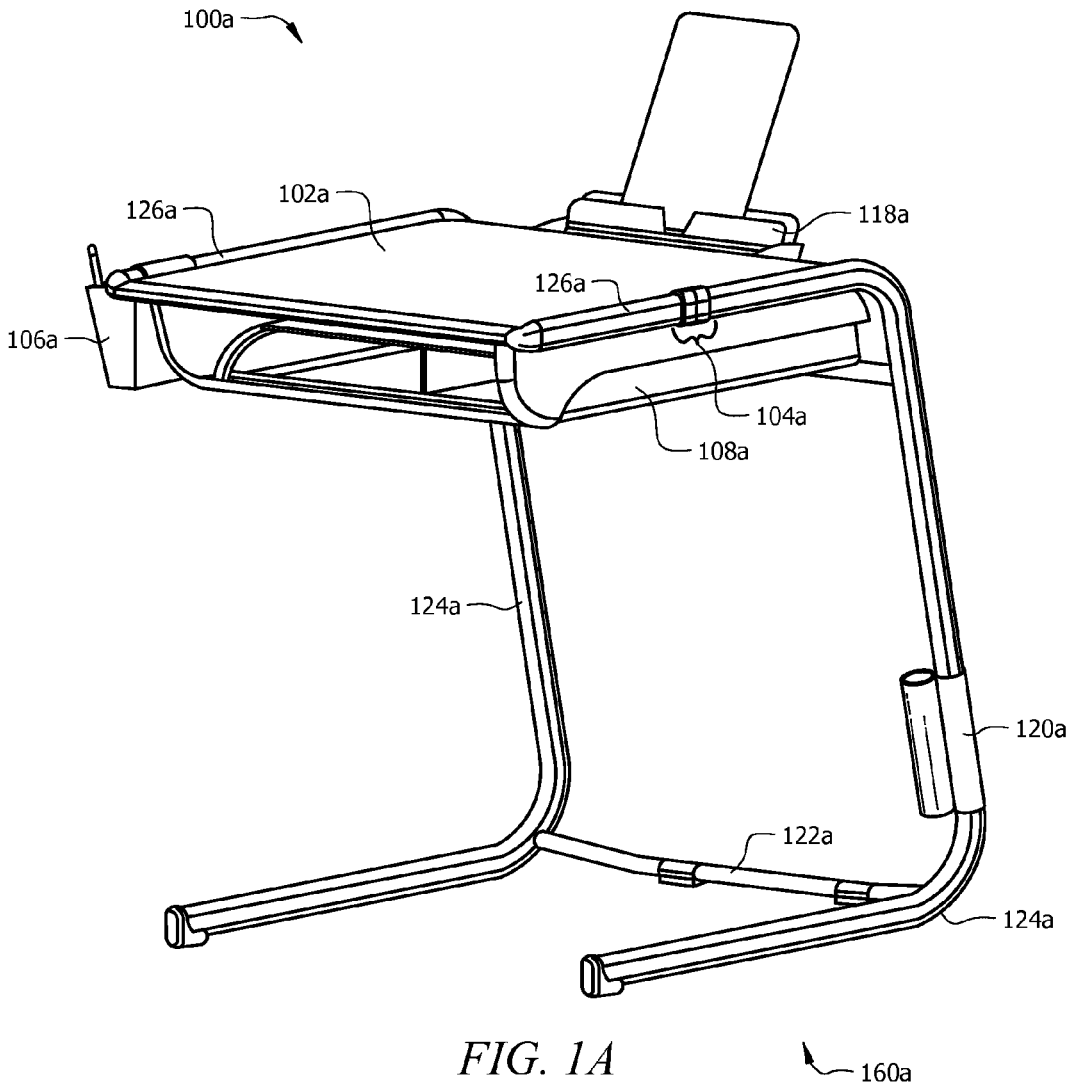
FIGS. 1A and 1B are perspective views of a system of modular desk components arranged in a first and second representative configuration according to embodiments of the present disclosure.

Referring now to FIG. 1A, a representative configuration 100*a* of components of a modular desk system is illustrated. Configuration 100*a* generally may comprise an assembly of modular components 160*a* (herein referred to as assembly 160*a*), according to embodiments of the present disclosure.

Assembly 160*a* may include top panel 102*a*, all-purpose hook 104*a*, cup hook 106*a*, storage shelf 108*a*, desktop organization member 118*a*, channel 120*a*, and kickstand base 122*a*, all coupled to support, frame 124*a*.

Top panel 102*a* may comprise a solid, flat surface inset within support frame 124*a*. In embodiments of the present disclosure, top panel 102*a* may be employed as a desk surface, writing surface, a workspace, a surface used in conjunction with educational study, a reading platform, a display platform, a media display and organization space, an organization platform, other suitable uses, or any combination thereof.

In embodiments of the present disclosure, all-purpose hook 104*a* may be employed to retain or otherwise support personal items such as book bags, handbags, computer bags, laptop bags, hats, coats, jackets, outerwear, scarves, other suitable personal items, or any combination thereof.

Cup hook 106*a* may be employed to retain or otherwise support objects such as pens, pencils, highlighters, styli, writing instruments, other working instruments, water bottles, soda bottles, coffee cups, other suitable drinkware, snack bags, other suitable items, or any combination thereof according to embodiments of the present disclosure.

In embodiments of the present disclosure, all-purpose hook 104*a* and cup hook 106*a* may be connected or otherwise coupled to support frame 124*a* in any suitable manner, such as, for example employing an s-hook to engage, spine 126*a* of support frame 124*a*, as shown in FIG. 1A. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, storage shelf 108*a* may be used to generally provide a full or partial enclosure. Storage shelf 108*a* may include any suitable pocket, storage area, surface, platform, plane, shelf, drawer, compartment, accessory, electrical outlet, telecommunications-related outlet, Ethernet outlet, WAN outlet, satellite outlet, cable outlet, audio/visual outlet, wire management system, other suitable housings, connections, outlets, or areas, or any combination thereof. In alternative embodiments, storage shelf 108*a* may further include a cover and locking mechanism to secure and lock an object in storage shelf 108*a*. Such a cover and locking mechanism may be any suitable size, shape, or configuration.

Assembly 160*a* may further include a desktop organization member 118*a*. In embodiments of the present disclosure, desktop organization member 118*a* may be employed to increase the efficiency of useable surface area of system 100*a*.

In one embodiment, desktop organization member 118*a* may be coupled to support frame 124*a*, as shown in FIG. 1A. In other embodiments, desktop organization member 118*a* may be integrated into top panel 102*a*. In alternative embodiments of the present disclosure, desktop organization member 118 may be coupled to the edge of system 100*a*, rather than being integrally constructed with system 100*a*.

In an engaged position, desktop organization member 118*a* may generally comprise a ledge and supporting wall which may be employed to support and display, for example, a tablet computer, as shown in FIG. 1A, a laptop computer, smart phone, electronic display, flat panel monitor, a television screen, liquid crystal display (LCD) screen, plasma screen, high definition television (HDTV) screen, projection television screen, computer screen, video conferencing display, other suitable devices, connections, outlets, or areas, or any combination thereof. Desktop organization member 118 may also be employed to support and display books, magazines, documents, other printed material, records, compact discs, collectable paraphernalia, personal items, a marker board, magnetic board, chalk board, tack board, sticker board, design board, other suitable, uses, or any combination thereof.

In a disengaged position, desktop organization member 118*a* may comprise a top surface, consistent with top panel 102*a*, or alternatively may have grooves or ridges that may be used to store pens, pencils, markers, other writing instruments, styli, other working instruments, other suitable objects, or any combination thereof.

Desktop organization member 118*a* may also comprise a nest which may house or otherwise retain a tablet computer, a laptop computer, smart phone, electronic display, flat panel monitor, a television screen, liquid crystal display (LCD) screen, plasma screen, high definition television (HDTV) screen, projection television screen, computer screen, video conferencing display, other suitable devices, connections, outlets, or areas, books, magazines, documents, other printed material, records, compact discs, collectable paraphernalia, personal items, a marker board, magnetic board, chalk board, tack board, sticker board, design board, other suitable items, or any combination thereof when not in use.

Channel 120*a* may comprise any suitably shaped, sized, or configured area and may be employed to store, route, secure, or otherwise organize wires, cables, and other electronic devices according to embodiments of the present disclosure. In embodiments of the present disclosure, channel 120 may be used to organize wire or cables associated with a laptop, computer, central processing unit (CPU), monitor, terminal, television, electronic display, external drive, storage device, computer accessory, lighting system, circuit breaker, electrical outlet, telecommunications-related outlet, Ethernet outlet, wide area network (WAN) outlet, satellite outlet, cable outlet, audio/visual outlet, wire management system, other suitable devices, objects, connections, outlets, or areas, or any combination thereof.

Figure 1B:
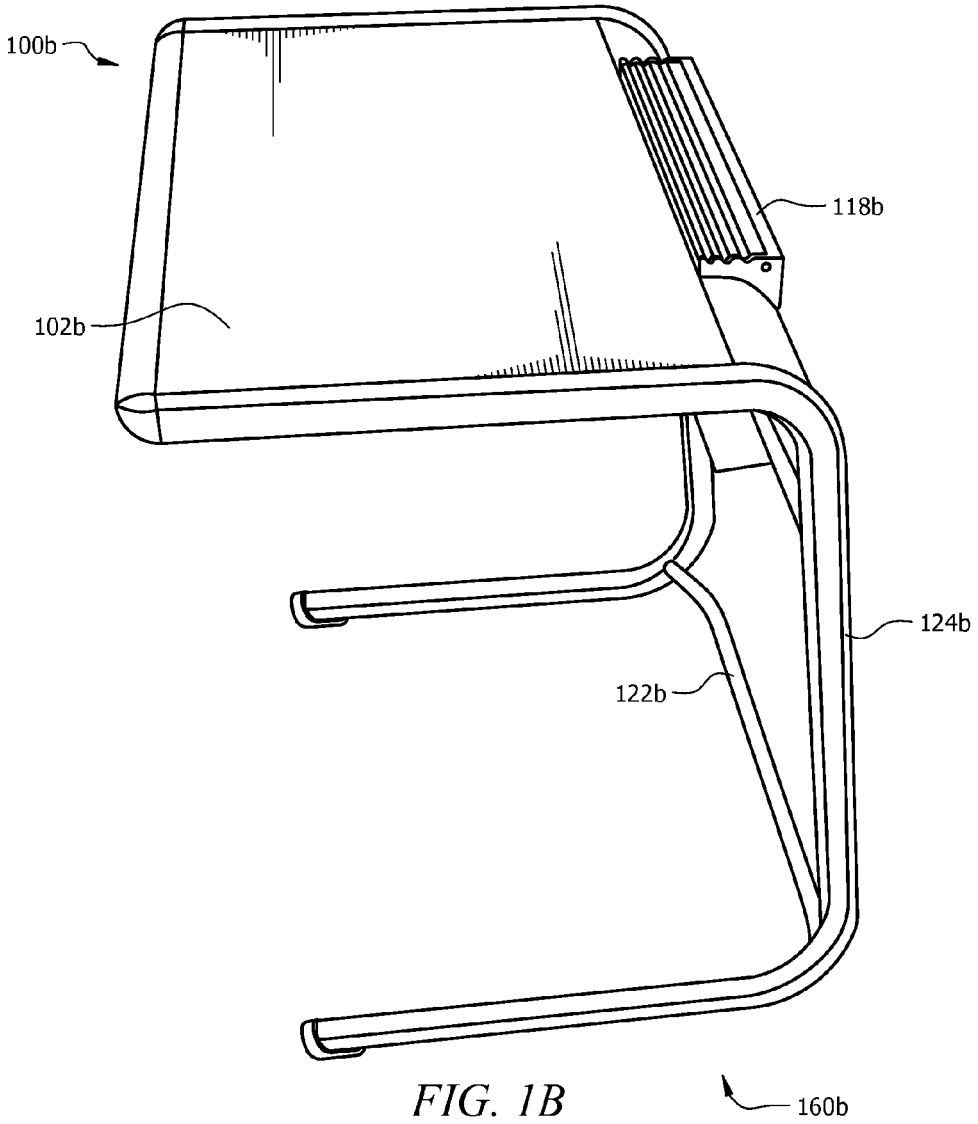

FIG. 1B is a perspective view of another representative configuration 100*b* of components of a modular desk system comprising a second assembly of modular components 160*b* (herein referred to as assembly 160*b*).

Assembly 160*b* may include top panel 102*b*, desktop organization member 118*b* and kickstand base 122*b*, all coupled to support frame 124*b*.

Two or more configuration assemblies of modular desk systems may be oriented next to each other, across from each other or engaging one another in other suitable patterns to create a continuous look among the plurality of assemblies, as exemplified in FIGS. 2-5.

Figure 2:
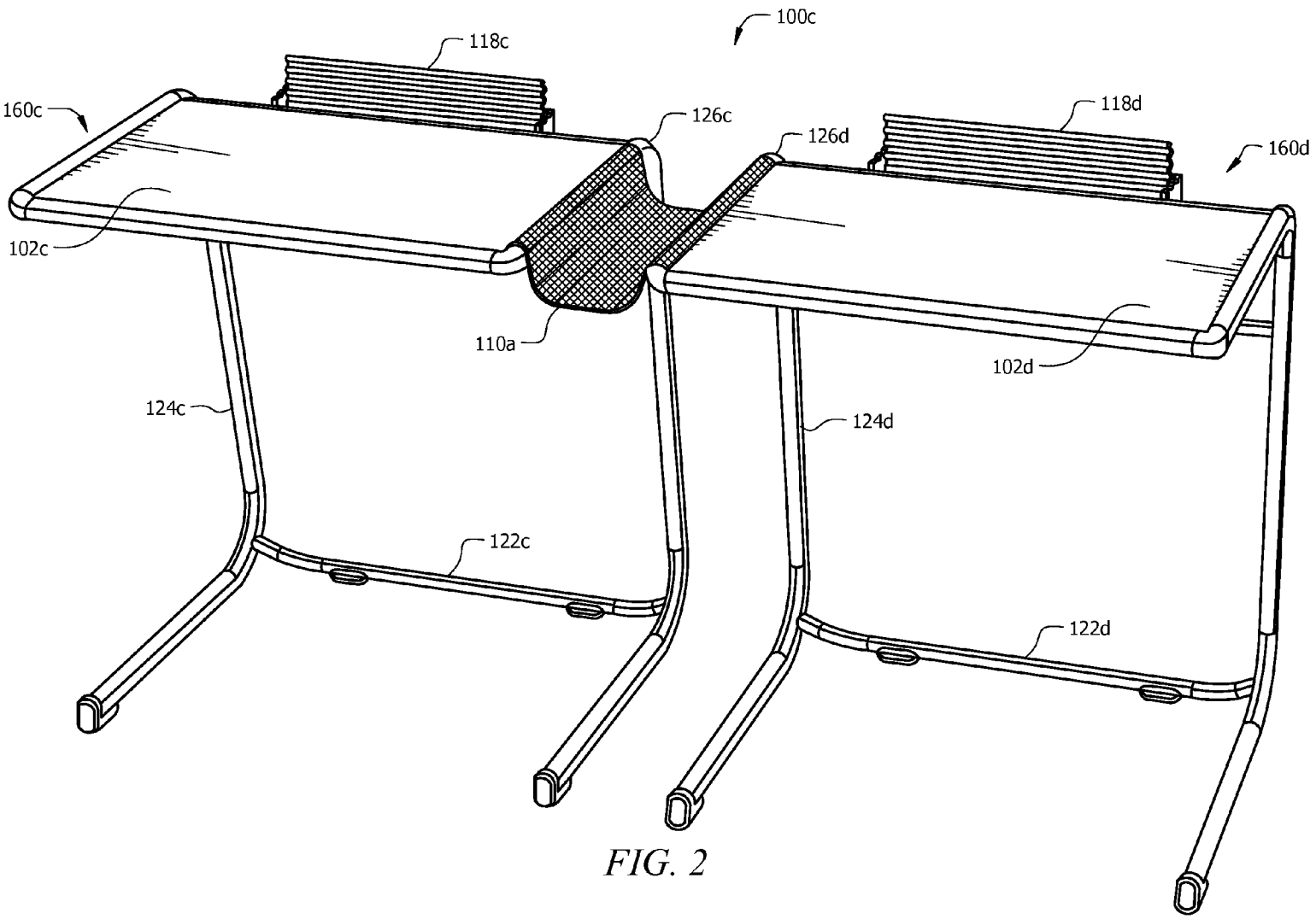
FIG. 2 is a perspective view of a system of modular desk components arranged in a third representative configuration according to embodiments of the present disclosure.

FIG. 2 is a perspective view of another representative configuration 100*c* of components of a modular desk system comprising a first assembly of modular components 160*c* (herein referred to as assembly 160*c*) and a second assembly of modular components 160*d* (herein referred to as assembly 160*d*), according to embodiments of the present disclosure.

Assembly 160*c* may include top panel 102*c*, desktop organization member 118*c* and kickstand base 122*c* coupled to a support frame 124*c*. Assembly 160*d* may include top panel 102*d*, desktop organization member 118*d* and kickstand base 122*d* coupled to support frame 124*d*. Assemblies 160*c* and 160*d* may or may not be coupled according to embodiments of the present disclosure. In an embodiment where assemblies 160*c* and 160*d* are coupled, configuration 100*c* may include connecting shelf 110*a* as shown in FIG. 2.

In an embodiment, each end of connecting shelf 110*a* may be connected or otherwise coupled to support frame 124*c* and support frame 124*d*, respectively, in any suitable manner, such as, for example employing an s-hook to engage spine 126*c* of support frame 124*c* and spine 126*d* of support frame 124*d*, as shown in FIG. 2. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present, disclosure, connecting shelf 110*a* may comprise a solid, flat surface. Connecting shelf 110*a* may be employed as an additional writing surface, a workspace, a surface used in conjunction with educational study, a reading platform, a display platform, a media display and organization space, an organization platform, other suitable uses, or any combination thereof that may be shared between coupled assemblies.

Figure 3:
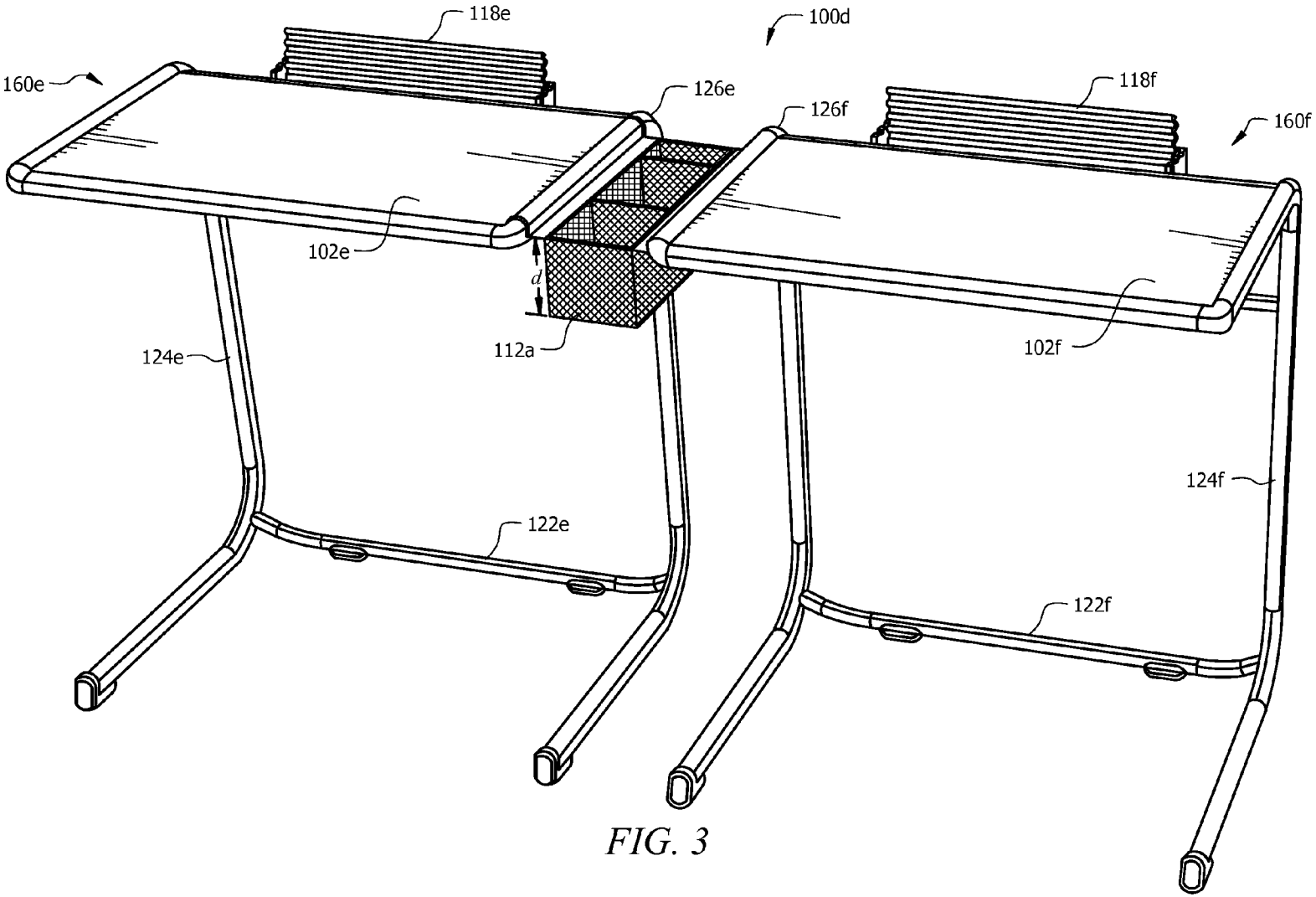
FIG. 3 is a perspective view of a system of modular desk components arranged in a fourth representative configuration according to embodiments of the present disclosure.

FIG. 3 is a perspective view of another representative configuration 100*d* of components of a modular desk system comprising a first assembly of modular components 160*e* (herein referred to as assembly 160*e*) and a second assembly of modular components 160*f* (herein referred to as assembly 160*f*), according to embodiments of the present disclosure.

Assembly 160*e* may include top panel 102*e*, desktop organization member 118*e* and kickstand base 122*e* coupled to support frame 124*e*. Assembly 160*f* may include top panel 102*f*, desktop organization member 118*f* and kickstand base 122*f* coupled to support frame 124*f*. Assemblies 160*e* and 160*f* may or may not be coupled according to embodiments of the present disclosure. In an embodiment where assemblies 160*e* and 160*f* are coupled, configuration 100*d* may include connecting planter box 112*a* as shown in FIG. 3.

In an embodiment, each end of connecting planter box 112*a* may be connected or otherwise coupled to support, frame 124*e* and support frame 124*f*, respectively, in any suitable manner, such as, for example employing an s-hook to engage spine 126*e* of support frame 124*e* and spine 126*f* of support frame 124*f*, as shown in FIG. 3. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, connecting planter box 112*a* may comprise a box having a depth (d). Connecting planter box 112*a* may be employed as planter box, a storage space, an organization space, other suitable uses, or any combination thereof that may be shared between, coupled assemblies.

Figure 4:
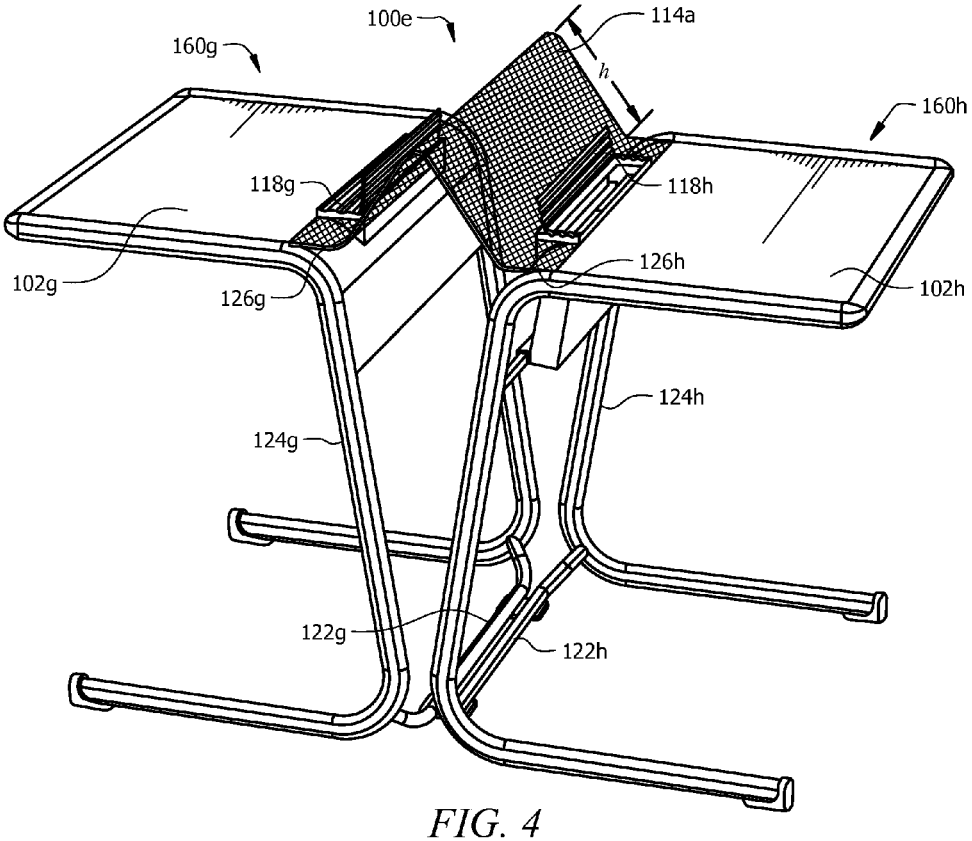
FIG. 4 is a perspective view of the system of modular desk components arranged in a fifth representative configuration according to embodiments of the present disclosure.

FIG. 4 is a perspective view of another representative configuration 100*e* of components of a modular desk system comprising a first assembly of modular components 160*g* (herein referred to as assembly 160*g*) and a second assembly of modular components 160*h* (herein referred to as assembly 160*h*), according to embodiments of the present disclosure.

Assembly 160*g* may include top panel 102*g*, desktop organization member 118*g* and kickstand base 122*g* coupled to support frame 124*g*. Assembly 160*h* may include top panel 102*h*, desktop organization member 118*b* and kickstand base 122*h* coupled to support frame 124*h*. Assemblies 160*g* and 160*h* may or may not be coupled according to embodiments of the present disclosure. In an embodiment where assemblies 160*g* and 160*h* are coupled, configuration 100*e* may include connecting divider 114*a* as shown in FIG. 4.

In an embodiment, each end of connecting divider 114*a* may be connected or otherwise coupled to support frame 124*g* and support frame 124*h*, respectively, in any suitable manner, such as, for example employing an s-hook to engage spine 126*g* of support frame 124*g* and spine 126*h* of support frame 124*h*, as shown in FIG. 4. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, connecting divider 114*a* may comprise a wall having a height (h). Connecting divider 114*a* may be employed as privacy wall, a white board, a chalk board, a marker board, a bulletin board, a tack board, a magnet board, or any combination thereof. Connecting divider 114*a* may also be employed to house, retain or support a shelf, artwork, display case, photo support frame, television screen, liquid crystal display (LCD) screen, plasma screen, high definition television (HDTV) screen, projection television screen, computer screen, laptop, computer, central processing unit (CPU), monitor, terminal, video conferencing display, radio, other suitable devices, or any combination thereof.

Figure 5:
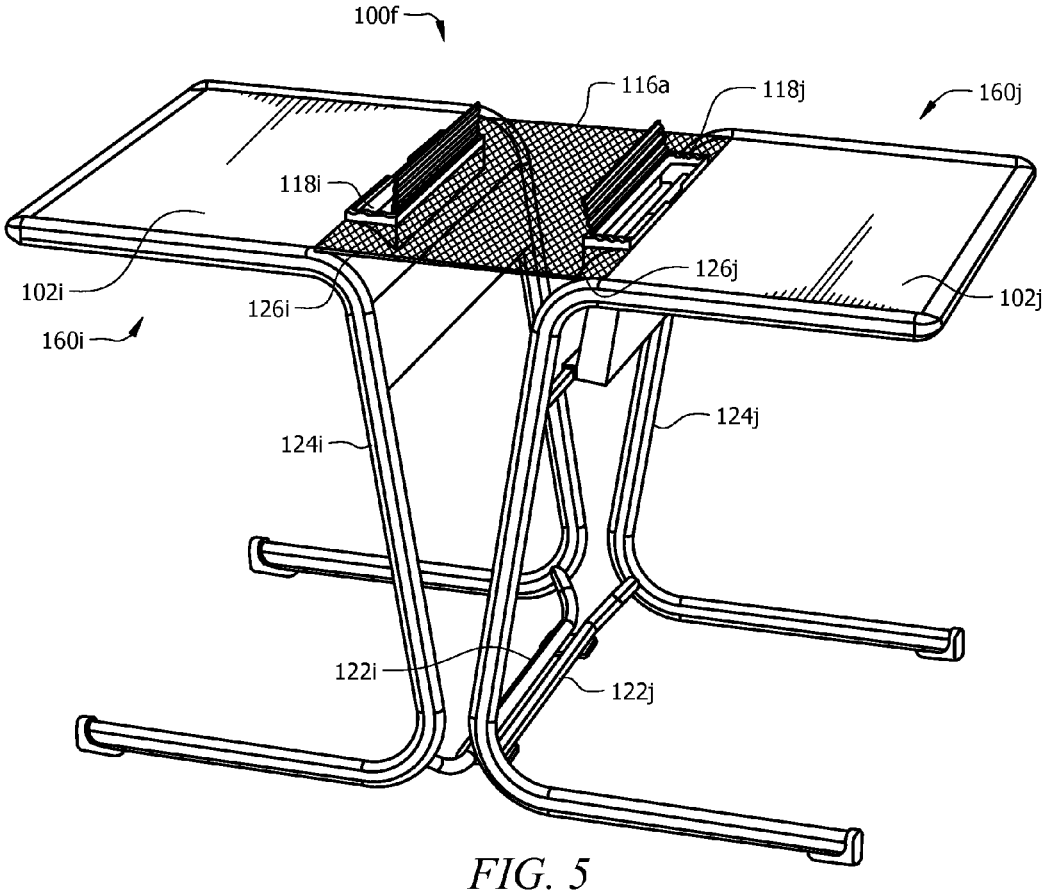
FIG. 5 is a perspective view of the system of modular desk components arranged in a sixth representative configuration according to embodiments of the present disclosure.

FIG. 5 is a perspective view of representative configuration 100*f* of components of a modular desk system comprising a first assembly of modular components 160*i* (herein referred to as assembly 160*i*) and a second assembly of modular components 160*j* (herein referred to as assembly 160*j*) according to embodiments of the present disclosure.

Assembly 160*i* may include top panel 102*i*, desktop organization member 118*i* and kickstand base 122*i* coupled to support frame 124*i*. Assembly 160*j* may include top panel 102*j*, desktop organization member 118*j* and kickstand base 122*j* coupled to support frame 124*j*. Assemblies 160*i* and 160*j* may or may not be coupled according to embodiments of the present disclosure. In an embodiment where assemblies 160*i* and 160*j* are coupled, configuration 100*f* may include connecting platform 116*a* as shown in FIG. 5.

In an embodiment, each end of connecting platform 116*a* may be connected or otherwise coupled to support frame 124*i* and support frame 124*j*, respectively, in any suitable manner, such as, for example employing an s-hook to engage spine 126*i* of support frame 124*i* and spine 126*j* of support frame 124*j*, as shown in FIG. 5. Such connections or couplings may be achieved in other suitable manners including a male and female coupling adapter, a screw and socket attachment, a clip or pin attachment, a ball and socket attachment, or other suitable connection or coupling mechanisms, or any combination thereof.

In embodiments of the present disclosure, connecting platform 116*a* may comprise a solid, flat surface. Connecting platform 116*a* may be employed as an additional writing surface, a workspace, a surface used in conjunction with educational study, a reading platform, a display platform, a media display and organization space, an organization platform, or any combination thereof. Connecting platform 116*a* may also be employed to house, retain or support a shelf, artwork, display case, photo support frame, television screen, liquid crystal display (LCD) screen, plasma screen, high definition television (HDTV) screen, projection television screen, computer screen, laptop, computer, central processing unit (CPU), monitor, terminal, video conferencing display, radio, other suitable devices, a white board, a chalk board, a marker board, a bulletin board, a tack board, a magnet board or any combination thereof.

In other embodiments, multiple other configurations of components of a modular desk system may be employed further demonstrating the flexibility and configurability of a modular desk system.

Figure 6A:
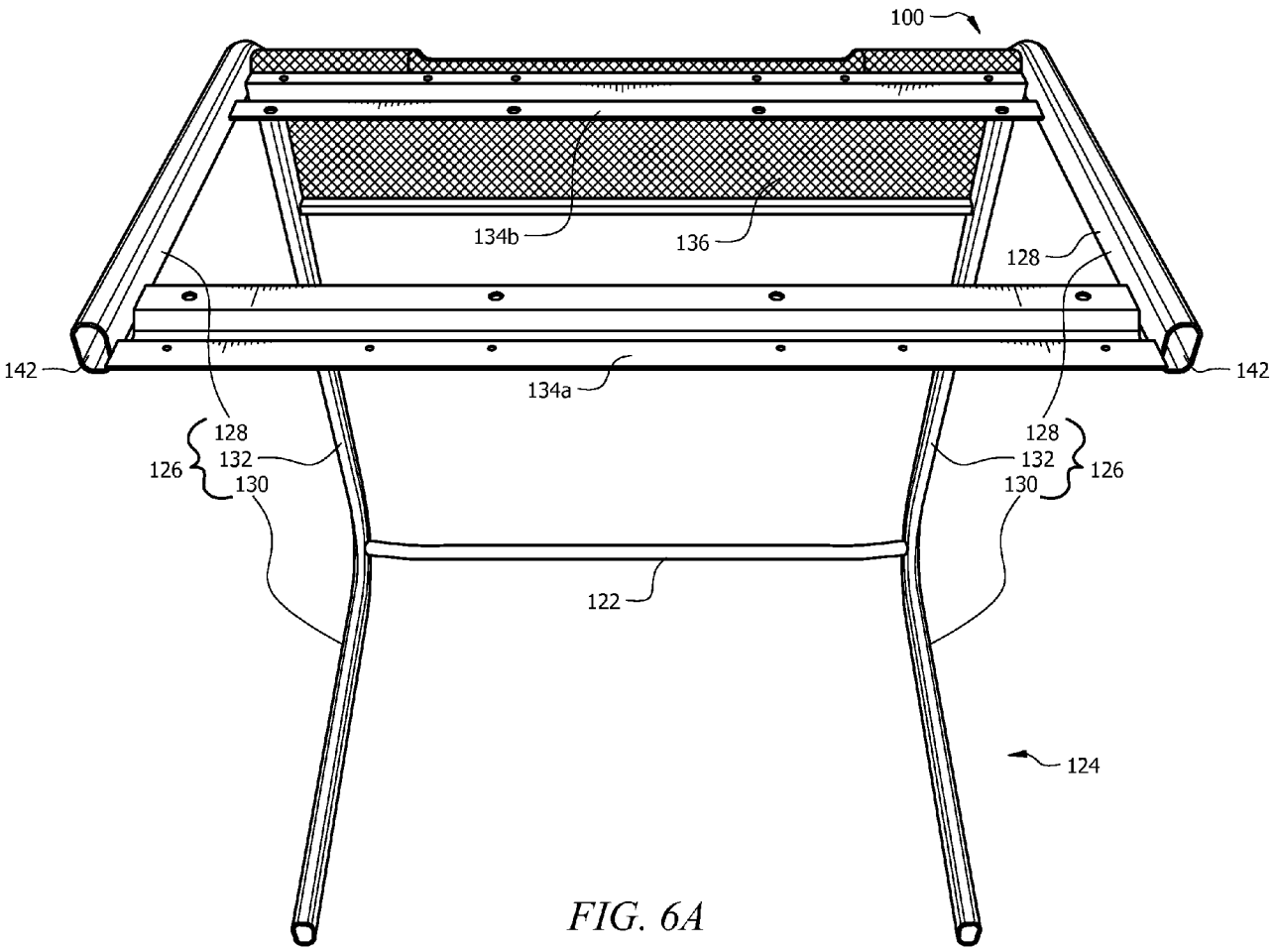
FIG. 6A is a perspective view of a representative support frame of the system of modular desk components according to embodiments of the present disclosure.
Figure 6B:
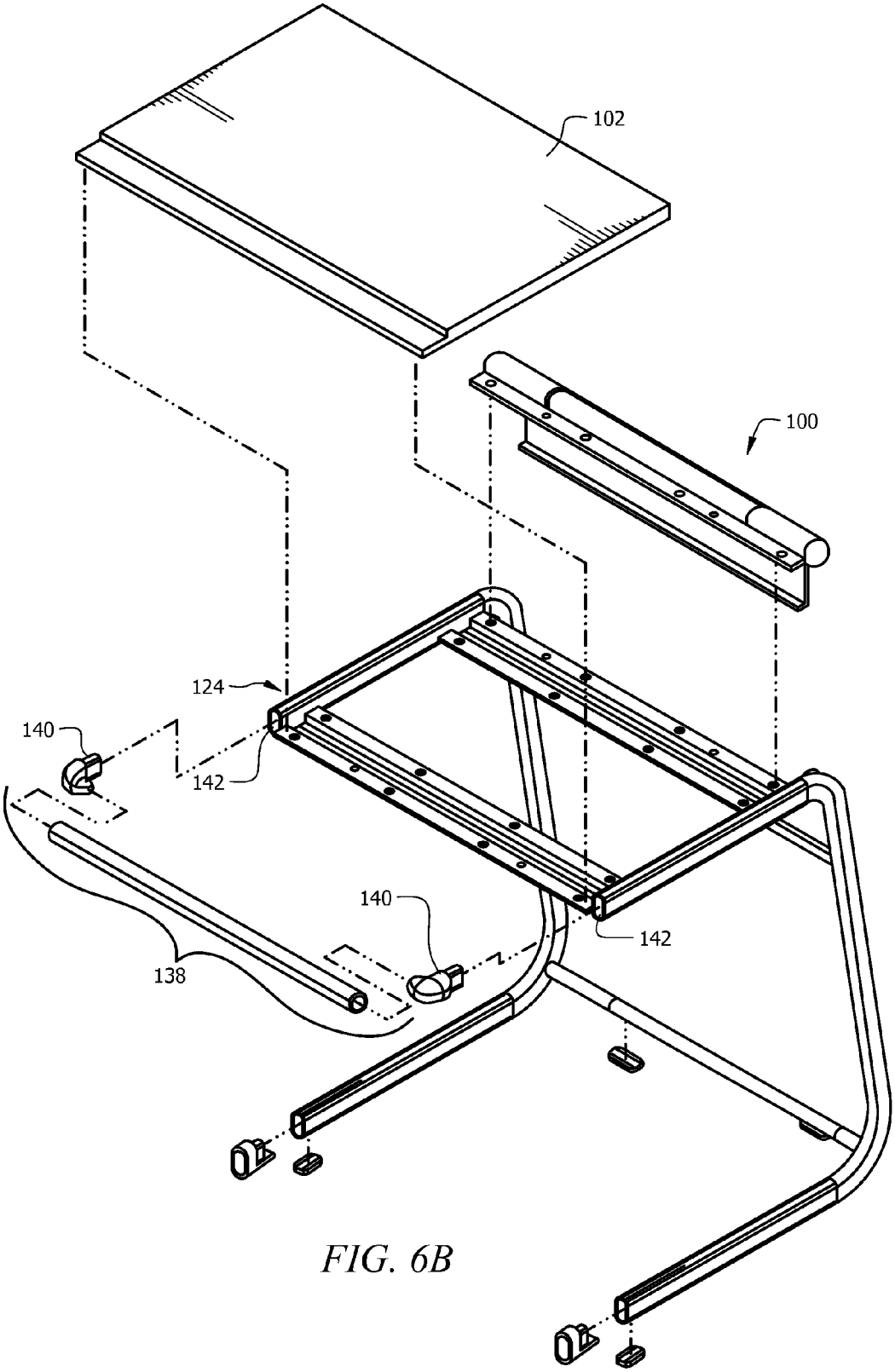
FIG. 6B provides an exploded view of a desk lip assembly connecting or coupling to the support frame shown in FIG. 6A according to embodiments of the present disclosure.
Figure 6C:
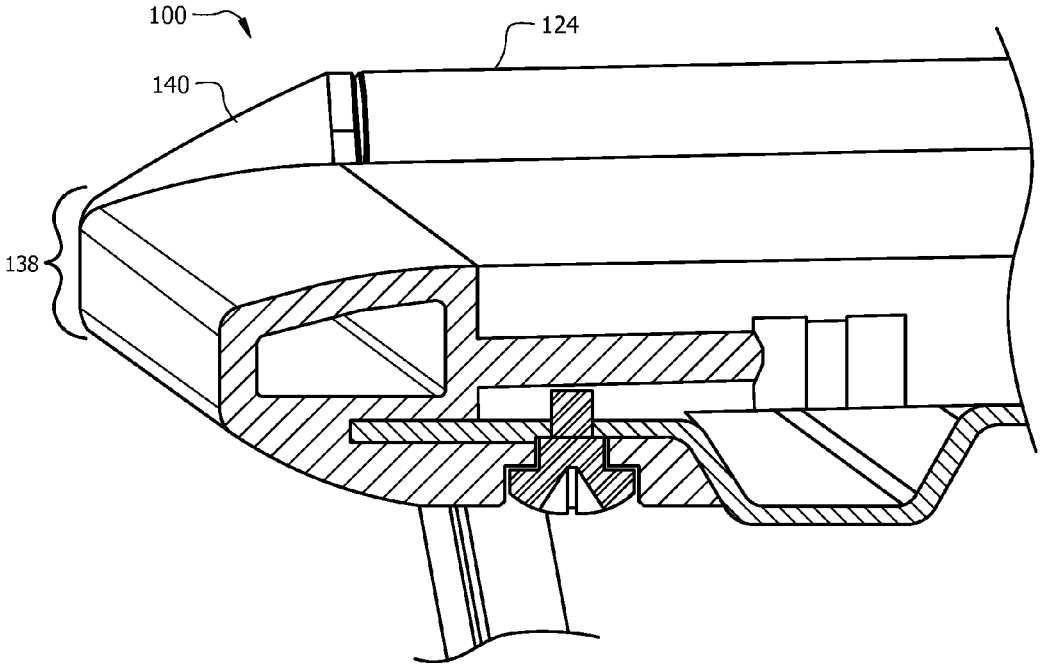
FIG. 6C provides a cross-sectional view of the desk lip assembly shown in FIG. 6B connected to or otherwise coupled to the support frame shown in FIG. 6A according to embodiments of the present disclosure.
Figure 6D:
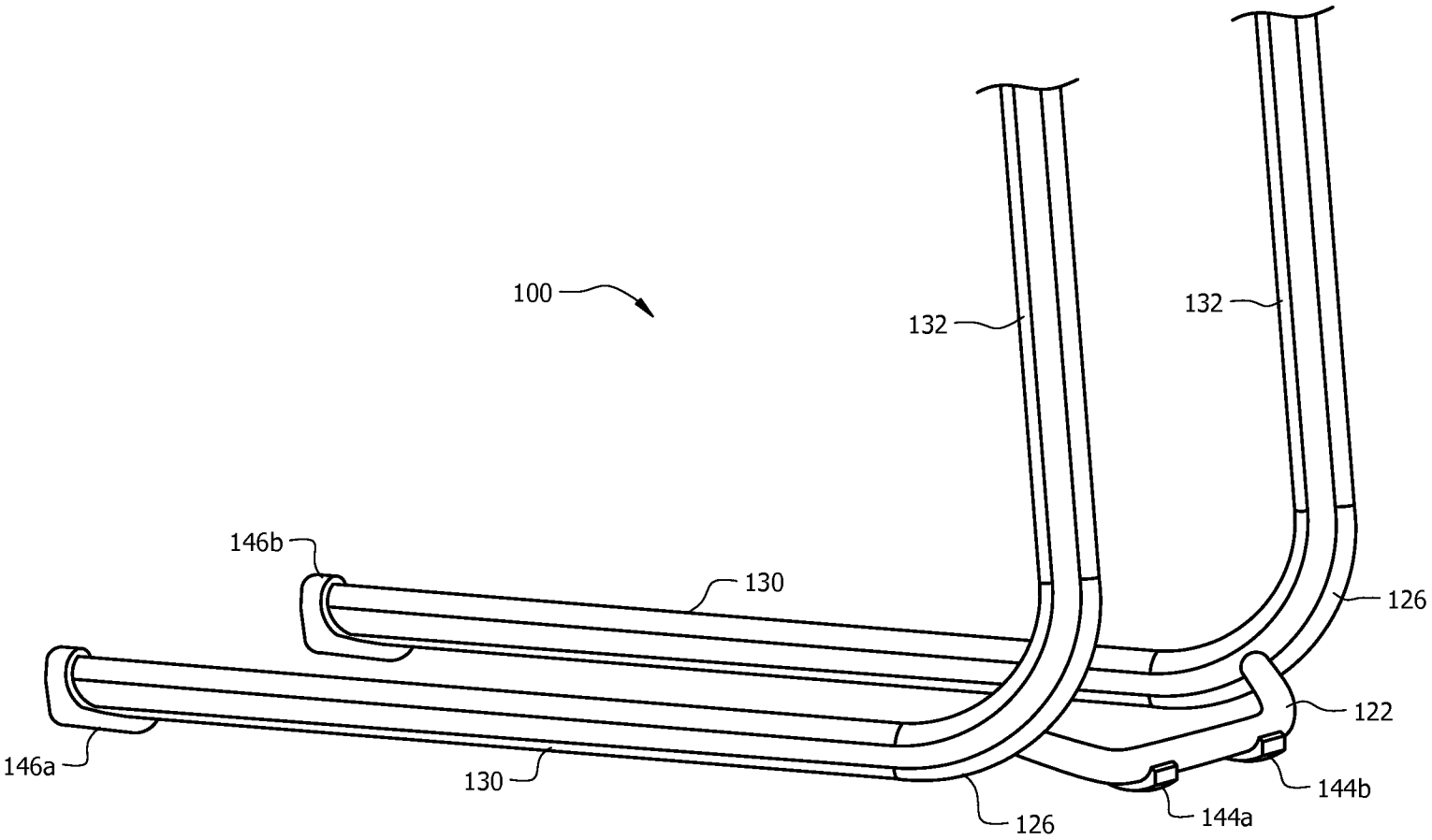
FIG. 6D is a perspective view of a representative kickstand base of the system of modular desk components connected or otherwise coupled to the support frame shown in FIG. 6A according to embodiments of the present disclosure.

FIG. 6A generally illustrates support frame 124 that may be employed in configurations 100*a*, 100*b*, 100*c*, 100*d*, 100*e* and 100*f* of FIGS. 1-5 and other suitable configurations according to embodiments of the present disclosure. FIG. 6B provides an exploded view of a desk lip assembly 138 connected to or otherwise coupled to the support frame 124 of FIG. 6A. FIG. 6C provides a cross-sectional view of the desk lip assembly 138 connected to or otherwise coupled to the support frame 124 of FIG. 6A. FIG. 6D provides a perspective view of a kickstand base 122 connected to or otherwise coupled to the support frame 124 of FIG. 6A.

Support frame 124 may include a pair of C-shaped side support frame spines 126 connected or otherwise coupled via top panel supports 134*a* and 134*b*, back brace 136, and kickstand 122. Each side support frame spine 126 includes a top panel support section 128, base section 130 and vertical section 132 therebetween.

In an embodiment, top panel support section 128 and vertical section 132 may be employed as handles to lift, carry and arrange a modular desk system.

In embodiments of the present disclosure, top panel supports 134*a* and 134*b* may be connected or otherwise coupled to the bottom surface of top panel 102, as shown in FIG. 6B, in any suitable manner, such as, for example via male and female coupling adapters, a screw and socket attachment, a nut and bolt attachment, a clip or pin attachment, a ball and socket-attachment, or other suitable connection or coupling mechanisms, or any combination thereof.

In embodiments of the present disclosure, top panel support sections 128 may be connected or otherwise coupled to the sides of top panel 102 in any suitable manner, such as, for example via male and female coupling adapters, a screw and socket attachment, a nut and bolt attachment, a clip or pin attachment, a ball and socket attachment, or other suitable connection or coupling mechanisms, or any combination thereof.

Top panel 102 may further be supported by back brace 136.

Desk lip assembly 138 may be employed to lock top panel 102 in place, while providing a leak proof seal to protect against liquid or solid spills from penetrating through a modular desk system, and thereby causing distress, morphing, buckling, or other similar states of wear.

In embodiments of the present disclosure, desk lip assembly 138 may be connected or otherwise coupled to support frame 124 in any suitable manner, such as, for example via male and female coupling adapters, which may include tabs 140 engaging slots 142 as shown in FIG. 6B. Such connections or couplings may be achieved in other suitable manners including a screw and socket attachment, a clip or pin attachment, a ball and socket attachment, or other suitable connection or coupling mechanisms, or any combination thereof.

Kickstand base 122 may be employed to provide solid structural integrity to a modular desk system 100. In embodiments of the present disclosure, kickstand base 122 connects or otherwise couples to spine 126 at the intersection of base section 130 and vertical section 132, as shown in FIG. 6C. The higher connection point between kickstand base 122 and spine 126 provides side stability for a modular desk system, while kickstand base 122 may be angled enough to provide sufficient push back when force is exerted against a modular desk system. In one embodiment, the width of kickstand base 122 may be wide enough to extensively engage the floor to create sufficient breadth to effectively prevent a modular desk system from tipping over.

Kickstand base 122 may also include stoppers 144*a* and 144*b* made of rubber or another resilient material with a high coefficient of friction such that when stoppers 144*a* and 144*b* engage the floor, stoppers 144*a* and 144*b* may further prevent, modular desk system 100 from tipping over.

Optionally, foot caps 146*a* and 146*b* may be employed to further provide stability to system 100. The large surface area of footcaps 146*a* and 146*b* may engage the floor causing friction to effectively prevent modular desk system 100 from unintentionally tipping.

In embodiments of the present disclosure, any of top panel 102, storage shelf 108, connecting shelf 110, connecting planter box 112, connecting divider 114, and/or connecting platform 116 may be made of, composed of, coated with, layered with, or otherwise include, for example, laminate, veneer, wood, cork, medium density fiber (MDF) board, particle board, melamine, granite, solid surface, tile, ceramic tile, fiberglass, soap stone, engineering stone, marble, concrete, slate, wood, butcher block, glass, steel, stainless steel, aluminum, metal, mesh, apertured material, plastic, blackboard material, wipe-off board material, mirror, paint, lacquer, polypropylene, polyurethane, polyethylene, polyvinyl chloride (PVC), silicon, polytetrafluoroethylene (PTFE), polyester, high-gloss polyester, synthetic rubber, natural rubber, polymer, fabric, natural fiber, synthetic fiber, other suitable materials, or any combination thereof.

Any of all-purpose hook 104, cup hook 106, desktop organization member 118, channel 120, kickstand base 122, support frame 124, rails 126, top panel support section 128, base section 120, vertical section 132, top panel supports 134*a* and 134*b*, and/or back brace 136, may be made of, composed of, or otherwise include, for example, steel, aluminum, brass, bronze, stainless steel, another type of metal, wood, nylon, plastic, polyurethane, polyethylene, polyvinyl chloride (PVC), polytetrafluoroethylene (PTFE), polyester, high-gloss polyester, laminate, plexiglass, polymer, other suitable, materials, or any combination thereof.

Any of all-purpose hook 104, cup hook 106, desktop organization member 118, channel 120, kickstand base 122, support frame 124, rails 126, top panel support section 128, base section 130, vertical section 132, top panel supports 134*a* and 134*b*, back brace 136, desk lip assembly 138, tabs 140, stoppers 144*a* and 144*b*, and/or footcaps 146*a* and 146*b* may be made of synthetic rubber, natural rubber, plastic, wood, polyester, high-gloss polyester, laminate, plexiglass, polymer, metal, steel, aluminum, brass, bronze, nylon, other suitable materials, or any combination thereof.

In an embodiment, any of top panel 102, storage shelf 108, connecting shelf 110, connecting planter box 112, connecting divider 114, connecting platform 116, all-purpose hook 104, cup hook 106, desktop organization member 118, channel 120, kickstand base 122, support frame 124, rails 126, top panel support section 128, base section 130, vertical section 132, top panel supports 134*a* and 134*b*, back brace 136, desk lip assembly 138, tabs 140, stoppers 144*a* and 144*b*, and/or footcaps 146*a* and 146*b* may include any number of suitable coatings and layers to substantially reduce scratching or injury to an object, or electronic media device supported by or retained within a modular desk system, as well as to any surface engaged by a modular desk system.

In one embodiment, the coatings and layers applied to any of top panel 102, storage shelf 108, connecting shelf 110, connecting planter box 112, connecting divider 114, connecting platform 116, all-purpose hook 104, cup hook 106, desktop organization member 118, channel 120, kickstand base 122, support frame 124, rails 126, top panel support section 128, base section 130, vertical section 132, top panel supports 134*a* and 134*b*, back brace 136, desk lip assembly 138, tabs 140, stoppers 144*a* and 144*b*, and/or footcaps 146*a* and 146*b* may be made of natural rubber, synthetic rubber, polymer, natural fiber, synthetic fiber, polyester, nylon, cotton, cotton mesh, vinyl, other suitable material, or any combination thereof.

In one embodiment, the coatings and layers applied to any of top panel 102, storage shelf 108, connecting shelf 110, connecting planter box 112, connecting divider 114, connecting platform 116, all-purpose hook 104, cup hook 106, desktop organization member 118, channel 120, kickstand base 122, support frame 124, rails 126, top panel support section 128, base section 130, vertical section 132, top panel supports 134*a* and 134*b*, back brace 136, desk lip assembly 138, tabs 140, stoppers 144*a* and 144*b*, and/or footcaps 146*a* and 146*b* may be embellished with different colors, patterns, camouflage patterns, wood grain patterns, novelty items, ornamental items, stickers, removable stickers, paints, stencils, chalks, designs, images, other decorative materials, or any combination thereof to enhance or otherwise achieve the desired décor of the surroundings.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A modular desk assembly comprising:

a first linkable desk, wherein the first linkable desk comprises:

a support frame, wherein the support frame comprises:

a pair of C-shaped spine members, wherein each C-shaped spine members comprises:

a first section;

a second section; and a third section vertically disposed between the first section and the second section, wherein the third section couples the first section and the second section; and a kickstand base, wherein the kickstand base couples the pair of C-shaped spine members, and wherein the kickstand base is disposed proximate the second sections and the third sections of the C-shaped spine members;

a top panel coupled to the first sections of the pair of C-shaped spine members of the support frame;

a storage shelf; and a desktop organization member;

wherein the first linkable desk is adapted to couple to a second linkable desk of a modular desk assembly, wherein the second linkable desk comprises a pair of C-shaped spine members.

2. The modular desk assembly of claim 1, wherein the desktop organization member comprises a nest coupled to a housing of the desktop organization member, and wherein the nest is adapted to store objects.

3. The modular desk assembly of claim 1, wherein the desktop organization member comprises a top surface, and wherein the top surface comprises ridges adapted to retain objects when the desktop organization member is in the closed position.

4. The modular desk assembly of claim 1, wherein a top panel of the desktop organization member is flush against an upper surface of a housing of the desktop organization member when the desktop organization member is in the closed position; and wherein when the desktop organization member is in the open position, the top panel of the desktop organization member leans against the housing of the desktop organization member such that the top panel of the desktop organization member and a ledge member of a desktop organization member form a display stand.

5. The modular desk assembly of claim 1, wherein the kickstand base comprises at least one stopper adapted to inhibit the first linkable desk from tipping over when a stopper is engaged with a floor.

6. The modular desk assembly of claim 1, wherein one or more of the C-shaped spine members comprise one or more footcaps adapted to engage with a floor.

7. The modular desk assembly of claim 1, further comprising one or more accessory hooks coupled to the support frame.

8. The modular desk assembly of claim 1, wherein the first linkable desk further comprises a channel coupled to the support frame, wherein the channel is adapted to secure at least one of wires or cables.

9. The modular desk assembly of claim 1, further comprising one or more additional linkable desks, wherein at least one of the additional linkable desks is coupled to the first linkable desk.

10. A modular desk assembly comprising:

a first linkable desk, wherein the first linkable desk comprises:

a first support flame, wherein the first support flame comprises:

a first pair of first C-shaped spine members, wherein each first C-shaped spine member comprises:

a first section;

a second section; and a third section vertically disposed between the first section and the second section, wherein the third section couples the first section and the second section; and a first kickstand base, wherein the first kickstand base couples the first pair of first C-shaped spine members, and wherein the first kickstand base is disposed proximate the second sections and the third sections of the first pair of first C-shaped spine members;

a first top panel coupled to the first support flame; and a first desktop organization member;

a second linkable desk, wherein the second linkable desk comprises:

a second support flame, wherein the second support flame comprises:

a second pair of second C-shaped spine members, wherein each second C-shaped spine member comprises:

a fourth section;

a fifth section; and a sixth section vertically disposed between the fourth section and the fifth section, wherein the sixth section couples the fourth section and the fifth section; and a second kickstand base, wherein the second kickstand base couples the second pair of second C-shaped spine members, and wherein the second kickstand base is disposed proximate the fifth sections and the sixth sections of the second pair of second C-shaped spine members;

a second top panel coupled to the second support frame; and a second desktop organization member; and a connection device connecting the first linkable desk to the second linkable desk.

11. The modular desk assembly of claim 10, wherein the connection device is at least one of a connecting shelf, a connecting planter box, a connecting divider, or a connecting platform.

12. The modular desk assembly of claim 10, wherein at least one of the first desktop organization member or the second desktop organization member comprises a nest adapted to store objects.

13. The modular desk assembly of claim 10, further comprising one or more stoppers coupled to at least one of the first kickstand base or the second kickstand base;

wherein one or more of the stoppers are adapted inhibit tipping when a stopper is engaged with a floor surface.

14. The modular desk assembly of claim 10, further comprising one or more footcaps coupled to at least one of the first C-shaped spine members or the second C-shaped spine members; wherein one or more of the footcaps are adapted to engage with a floor.

15. The modular desk assembly of claim 10 further comprising at least one of a storage shelf coupled to the first support frame, an accessory hook coupled to the first support frame, a storage shelf coupled to the second support frame, or an accessory hook coupled to the second support frame.

16. A linkable desk comprising:

a support frame comprising:

a pair of C-shaped spine members, wherein each C-shaped spine member comprises:

a base section comprising:

a first end; and a second opposing end;

a top panel support section; and a vertical section, wherein a first end of the vertical section is coupled to a first end of the base section;

and wherein the base section, the top panel support section, and the vertical section are coupled to form a C-shape;

a kickstand base coupling each of the C-shaped spine members together, wherein the kickstand base is coupled at each end proximate the first end of the vertical section of each of the C-shaped spine members and proximate the first end of the base section of each of the C-shaped spine members;

and wherein an opening is disposed between the second ends of each of the base sections of the C-shaped spine members;

a top panel coupled to the support frame, wherein a second opposing end of the vertical section is coupled to the top panel support section;

a desktop organization member; and a channel coupled to the support frame, wherein the channel is adapted to secure at least one of wires or cables;

wherein a linkable desk is adapted to couple to at least one other linkable desk.

17. The desk of claim 16, wherein a top panel of the desktop organization member is flush against an upper surface of a housing of the desktop organization member when the desktop organization member is in the closed position; and wherein when the desktop organization member is in the open position, the top panel of the desktop organization member leans against the housing of the desktop organization member such that the top panel of the desktop organization member and a ledge member of the desktop organization member form a display stand.

18. The desk of claim 16, wherein a top surface of the desktop organization member comprises ridges adapted to retain objects when the desktop organization member is in the closed position.

19. The desk of claim 16, further comprising a storage shelf coupled to the support frame.

20. The desk of claim 16, further comprising one or more accessory hooks coupled to the support frame.

* * * * *